US008670684B2

(12) United States Patent
Isoda

(10) Patent No.: US 8,670,684 B2
(45) Date of Patent: Mar. 11, 2014

(54) IMAGE FORMING APPARATUS

(71) Applicant: Keisuke Isoda, Osaka (JP)

(72) Inventor: Keisuke Isoda, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/656,254

(22) Filed: Oct. 19, 2012

(65) Prior Publication Data

US 2013/0108293 A1 May 2, 2013

(30) Foreign Application Priority Data

Oct. 31, 2011 (JP) ..... 2011-238134

(51) Int. Cl.
*G03G 15/00* (2006.01)

(52) U.S. Cl.
USPC ..... 399/49

(58) Field of Classification Search
USPC ..... 399/49
See application file for complete search history.

(56) References Cited

U.S. PATENT DOCUMENTS

2006/0204267 A1 * 9/2006 Watanabe ..... 399/74

FOREIGN PATENT DOCUMENTS

| | | |
|---|---|---|
| JP | H06-250480 | 9/1994 |
| JP | 2003-029476 | 1/2003 |
| JP | 2007-333760 | 12/2007 |
| JP | 2007333760 A * | 12/2007 |

OTHER PUBLICATIONS

Machine translation into English language of Watanabe, Masao—JP2007333760.*

* cited by examiner

*Primary Examiner* — Thomas R Artman
*Assistant Examiner* — Arlene Heredia Ocasio
(74) *Attorney, Agent, or Firm* — Stephen Chin

(57) ABSTRACT

An image forming apparatus of the present disclosure includes: an image carrier configured to carry toner patches; a first sensor configured to irradiate S-polarized light to a low-density patch in a predetermined low density range among the toner patches, and to receive reflection light from the low-density patch; and a second sensor configured to irradiate P-polarized light to a high-density patch in a predetermined high density range among the toner patches, and to receive reflection light from the high-density patch.

7 Claims, 4 Drawing Sheets

IMAGE FORMING APPARATUS

CROSS-REFERENCE TO RELATED APPLICATIONS

This application relates to and claims priority rights from a Japanese Patent Application No. 2011-238134, filed on Oct. 31, 2011, the entire disclosures of which are hereby incorporated by reference herein.

BACKGROUND OF THE INVENTION

1. Field of the Invention

The present invention relates to image forming apparatuses.

2. Description of the Related Art

In many image forming apparatuses that form images by electronic photography process, such as printer, copier, facsimile, and multi-function peripheral thereof, a toner image is developed on a photoconductor drum, and the toner image is transferred onto an intermediate transfer belt, and then transferred from the intermediate transfer belt to a paper sheet, and finally the toner image is fixed on the paper sheet.

Such image forming apparatuses perform toner density correction and color registration correction when required or periodically.

In general, in a process of the density correction, a toner pattern (i.e. plural toner patches) as reference is developed and transferred to the intermediate transfer belt, toner densities of the toner pattern on the intermediate transfer belt is determined using an optical sensor, and the density correction is performed on the basis of the toner densities. Further, in case of a color image forming apparatus, positions of the toner pattern on the intermediate transfer belt are determined, and the color registration correction is performed on the basis of the positions.

Furthermore, there is another technique to determine toner densities on the photoconductor drum.

In a sensor for measuring the toner densities, a beam splitter separates a light beam emitted from a light emitting diode into a predetermined polarized component (either P-polarized component or S-polarized component), and the predetermined polarized component enters the toner pattern on the intermediate transfer belt. Reflection light from the toner pattern is separated into a specular reflection component and a diffuse reflection component by a beam splitter, and these components are detected by photo detectors. Finally, the toner density is determined from intensities of the specular reflection component and the diffuse reflection component. If the incident light to the toner pattern is P-polarized, then the specular reflection component is P-polarized, for instance.

Further, another image forming apparatus uses a low pass filter to reduce noise due to a stain or a scratch on a surface in toner density measurement of a low density range.

However, since toner absorbs light, it is difficult to precisely measure toner densities of all the toner patches from low density range to high density range using the aforementioned reflection-type sensor.

For example, when a toner density is calculated on the basis of a difference between measurement values of the specular reflection component and the diffuse reflection component, the difference is small under some measurement conditions of the sensor, and it causes low measurement precision. In particular, black toner strongly absorbs light, and it may cause very low measurement precision of black toner.

SUMMARY OF THE INVENTION

An image forming apparatus according to an aspect of the present disclosure includes: an image carrier configured to carry toner patches; a first sensor configured to irradiate S-polarized light to a low-density patch in a predetermined low density range among the toner patches, and to receive reflection light from, the low-density patch; and a second sensor configured to irradiate P-polarized light to a high-density patch in a predetermined high density range among the toner patches, and to receive reflection light from the high-density patch.

Therefore, different light components are irradiated to respective toner patches in the low density range and in the high density range. Consequently, toner densities of the toner patches are precisely measured from a low density range to a high density range using the aforementioned reflection-type sensor.

These and other objects, features and advantages of the present invention will become more apparent upon reading of the following detailed description along with the accompanied drawings.

DETAILED DESCRIPTION

Hereinafter, an embodiment according to aspects of the present invention will be explained with reference to drawings.

Figure 1:
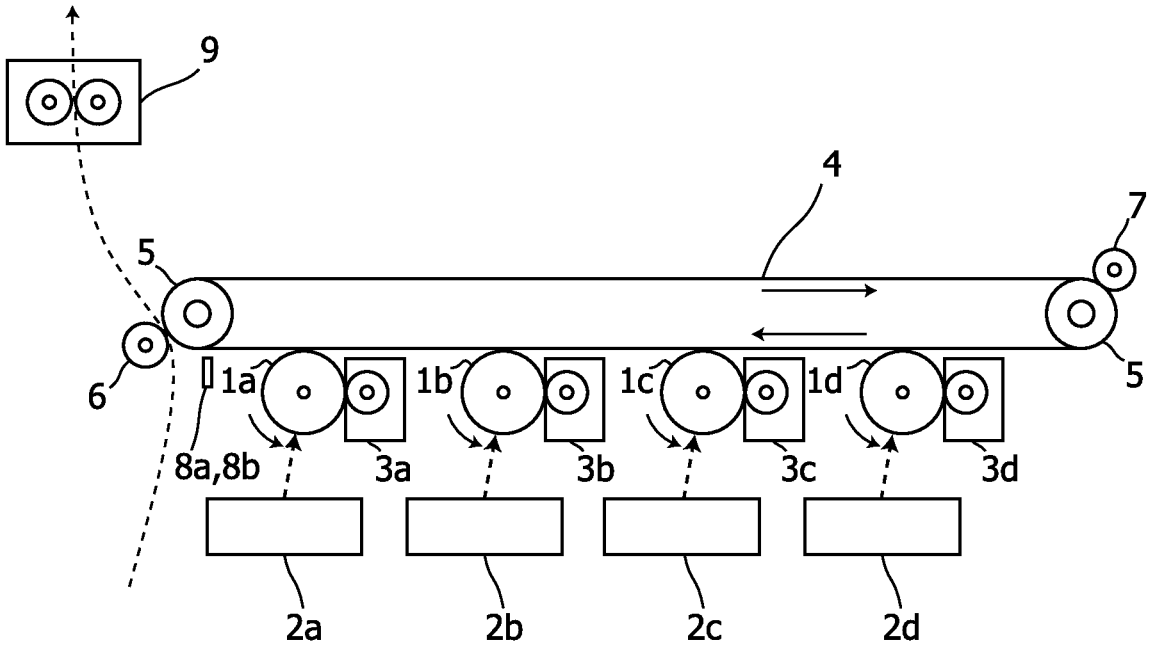
FIG. 1 is a side view that shows an internal mechanical configuration of an image forming apparatus in an embodiment according to the present disclosure.

FIG. 1 is a side view that shows an internal mechanical configuration of an image forming apparatus in an embodiment according to the present disclosure. The image forming apparatus is an apparatus having a printing function such as printer, facsimile apparatus, copier, or multi-function peripheral.

The image forming apparatus in this embodiment has a tandem-type color development device. This color development device has photoconductor drums 1*a* to 1*d*, exposure devices 2*a* to 2*d*, and development units 3*a* to 3*d*. The photoconductor drums 1*a* to 1*d* are photoconductors of four colors: Cyan, Magenta, Yellow and Black. For instance, the photoconductor drums 1*a* to 1*d* are made of amorphous silicon. The exposure devices 2*a* to 2*d* are devices that form electrostatic latent images by irradiating laser light to the photoconductor drums 1*a* to 1*d*. Each of the exposure devices 2*a* to 2*d* includes a laser diode as a light source of the laser light, optical elements (such as lens, mirror and polygon mirror) that guide the laser light to the photoconductor drum 1*a*, 1*b*, 1*c*, or 1*d*.

Further, in the periphery of each of the photoconductor drums 1*a* to 1*d*, a charging unit such as scorotron, a cleaning device, a static electricity eliminator and so on are disposed. The cleaning device removes residual toner on the photoconductor drum 1*a*, 1*b*, 1*c*, or 1*d* after primary transfer. The static electricity eliminator eliminates static electricity of the photoconductor drum 1*a*, 1*b*, 1*c*, or 1*d* after primary transfer.

The development units 3*a* to 3*d* include respective toner containers filled with four color toner of Cyan, Magenta, Yellow and Black, and make the toner adhere to electrostatic latent images on the photoconductor drums 1*a* to 1*d* to form toner images. A developer is composed of the toner and a carrier with external additives such as titanium dioxide.

The photoconductor drum 1*a*, the exposure device 2*a* and the development unit 3*a* perform development of Magenta. The photoconductor drum 1*b*, the exposure device 2*b* and the development unit 3*b* perform development of Cyan. The photoconductor drum 1*c*, the exposure device 2*c* and the development unit 3*c* perform development of Yellow. The photoconductor drum 1*d*, the exposure device 2*d* and the development unit 3*d* perform development of Black.

The intermediate transfer belt 4 is a loop-shaped image carrier and intermediate transfer member, and contacts the photoconductor drums 1*a* to 1*d*. Toner images on the photoconductor drums 1*a* to 1*d* are primarily transferred onto the intermediate transfer belt 4. The intermediate transfer belt 4 is hitched round driving rollers 5, and rotates by driving force of the driving rollers 5 towards the direction from the contact position with the photoconductor drum 1*d* to the contact position with the photoconductor drum 1*a*.

A transfer roller 6 makes a conveyed paper sheet contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet.

Sensors 8*a* and 8*b* irradiate respective light to the intermediate transfer belt 4, and detect respective reflection light from a surface of the intermediate transfer belt 4 or a toner pattern on the surface of the intermediate transfer belt 4. In toner density adjustment, the sensors 8*a* and 8*b* irradiate respective light to predetermined areas on the intermediate transfer belt 4, detect respective reflection light, and output respective electrical signals corresponding to the detected intensities of the respective reflection light.

Figure 2:
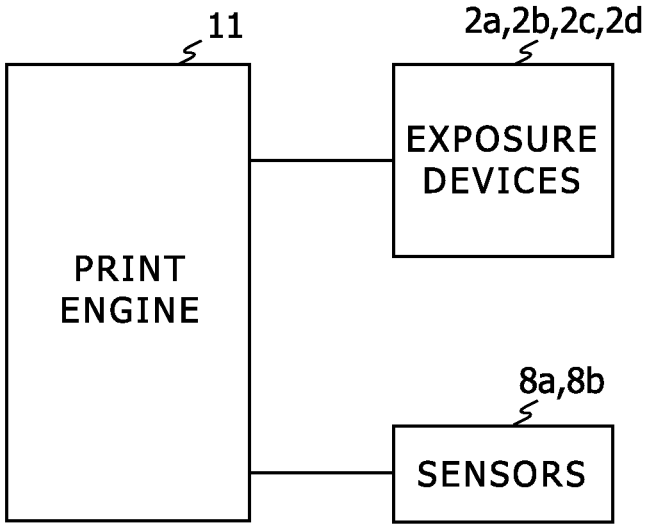
FIG. 2 is a block diagram that shows an electronic configuration of the image forming apparatus in the embodiment according to the present disclosure.

FIG. 2 is a block diagram that shows an electronic configuration of the image forming apparatus in the embodiment according to the present disclosure. In FIG. 2, a print engine 11 is a processing circuit that controls a driving source that drives the aforementioned rollers, a bias induction circuit that induces a development bias and a primary transfer bias, and controls the exposure devices 2*a* to 2*d* in order to perform developing, transferring and fixing the toner image, feeding a paper sheet, printing on the paper sheet, and outputting it. The development biases are applied between the photoconductor drums 1*a* to 1*d* and the development units 3*a* to 3*d*, respectively. The primary transfer biases are applied between the photoconductor drums 1*a* to 1*d* and the intermediate transfer belt 4, respectively.

Further, the print engine 11 calculates a toner density of a toner patch in a predetermined low density range on the basis of P-polarized component and S-polarized component of the reflection light detected by the sensor 8*a*, and calculates a toner density of a toner patch in a predetermined high density range on the basis of P-polarized component and S-polarized component of the reflection light detected by the sensor 8*b*.

In toner density adjustment, the print engine 11 rotates the intermediate transfer belt 4 using the driving rollers 5, and controls the exposure devices 2*a* to 2*d* etc. to form a toner pattern (plural series of toner patches) of each color on a predetermined area on a surface of the intermediate transfer belt 4.

Figure 3:
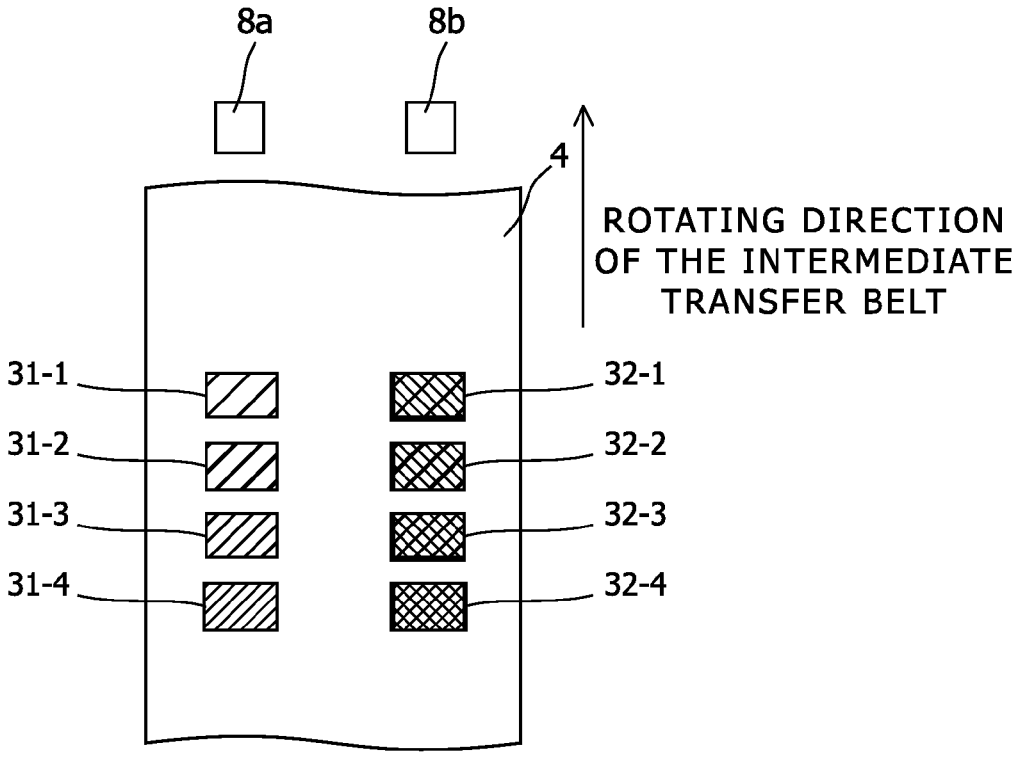
FIG. 3 is a diagram that shows an example of positions of sensors and plural series of toner patches in FIG. 1.

FIG. 3 is a diagram that shows an example of positions of the sensors 8*a* and 8*b* and plural series of toner patches in FIG. 1.

As shown in FIG. 3, toner patches 31-1 to 31-4 in the low density range and toner patches 32-1 to 32-4 in the high density range are formed in two rows and in parallel. In this embodiment, a half of the eight toner patches 31-1 to 31-4 and 32-1 to 32-4 and the other half are formed in two rows. Here, the number of the toner patches 31-1 to 31-4 in the low density range is the same as the number of the toner patches 32-1 to 32-4 in the high density range. Alternatively, these numbers may not be the same.

The toner patches 31-1 to 31-4 in the low density range are formed with respective predetermined densities (here, 12.5%, 25%, 37.5%, and 50%), and the toner patches 32-1 to 32-4 in the high density range are formed with respective predetermined densities (here, 62.5%, 75%, 87.5%, and 100%) higher than the predetermined densities of the toner patches 31-1 to 31-4.

The sensor 8*a* is disposed at a position corresponding to a position through which the toner patches 31-1 to 31-4 in the low density range pass, and irradiates S-polarized light to the toner patches 31-1 to 31-4 in the low density range. The sensor 8*b* is disposed at a position corresponding to a position through which the toner patches 32-1 to 32-4 in the high density range pass, and irradiates P-polarized light to the toner patches 32-1 to 32-4 in the high density range. Therefore, densities of the toner patches 31-1 to 31-4 in the low density range are measured using the sensor 8*a*, and densities of the toner patches 32-1 to 32-4 in the high density range are measured using the sensor 8*b*.

Although in FIG. 3 the toner patches of one color is depicted, in this embodiment, the toner patches of all colors (Black, Cyan, Magenta, and Yellow) are formed as well as depicted.

Here, details of the sensors 8*a* and 8*b* are explained.

Figure 4:
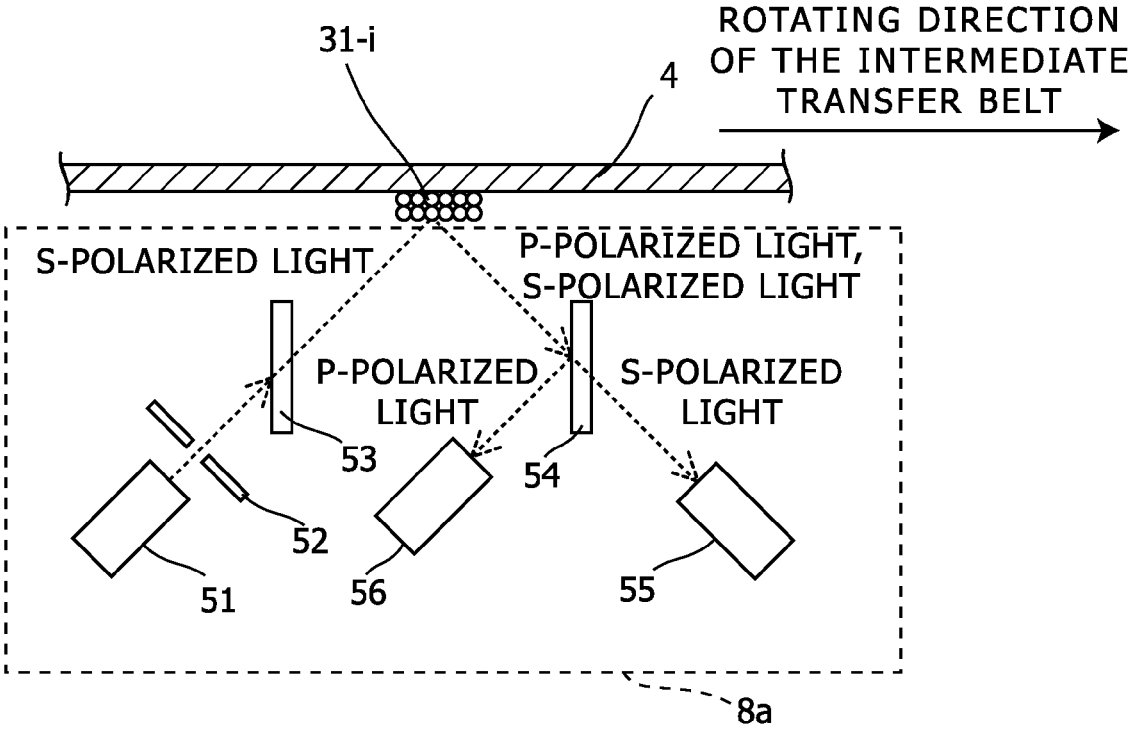
FIG. 4 is a diagram that shows a detailed configuration of the sensor 8*a* in FIG. 1.
Figure 5:
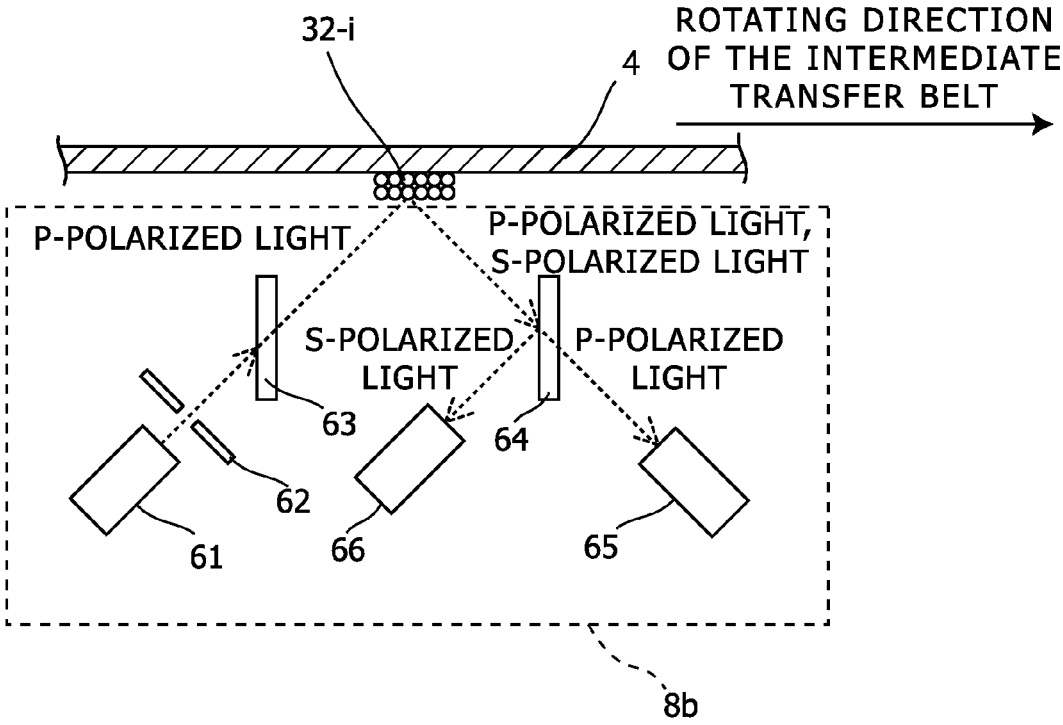
FIG. 5 is a diagram that shows a detailed configuration of the sensor 8*b* in FIG. 1.

FIG. 4 is a diagram that shows a detailed configuration of the sensor 8*a* in FIG. 1. FIG. 5 is a diagram that shows a detailed configuration of the sensor 8*b* in FIG. 1.

As shown in FIG. 4, the sensor 8*a* includes a light source 51 emitting a light, an aperture 52 which is disposed in the light source 51 side, a beam splitter 53 which is disposed in the light source 51 side, a beam splitter 54 which is disposed in the light receiving side, a first photo detector 55, and a second photo detector 56. In this embodiment, the light source 51 is a light emitting diode.

The beam splitter 53 is a polarizing element which passes a predetermined polarized component in the light emitted from the light source 51. The beam splitter 54 is a polarizing element which passes a predetermined polarized component in the reflection light from either a surface of the intermediate transfer belt 4 or a toner pattern (toner patches 31-1 to 31-M; here, M=4) on the surface.

In this embodiment, the beam splitter 53 passes an S-polarized component (i.e. S-polarized light) and reflects a P-polarized component (i.e. P-polarized light) in incident light from the light source 51. The beam splitter 54 passes an S-polarized component (i.e. the specular component) and reflects a P-polarized component in the reflection light. The first photo detector 55 receives this S-polarized light, and the second photo detector 56 receives this P-polarized light.

As shown in FIG. 5, the sensor 8*b* includes a light source 61 emitting a light, an aperture 62 which is disposed in the light source 61 side, a beam splitter 63 which is disposed in the light source 61 side, a beam splitter 64 which is disposed in the light receiving side, a third photo detector 65, and a fourth photo detector 66. In this embodiment, the light source 61 is a light emitting diode.

The beam splitter 63 is a polarizing element which passes a predetermined polarized component in the light emitted from the light source 61. The beam splitter 64 is a polarizing element which passes a predetermined polarized component in the reflection light from either a surface of the intermediate transfer belt 4 or a toner pattern (toner patches 32-1 to 32-N; here, N=4) on the surface.

In this embodiment, the beam splitter 63 passes a P-polarized component and reflects an S-polarized component in incident light from the light source 61. The beam splitter 64 passes a P-polarized component (i.e. the specular component) and reflects an S-polarized component in the reflection light. The third photo detector 65 receives this P-polarized light, and the fourth photo detector 66 receives this S-polarized light.

The beam splitters 53, 54, 63, and 64 include respective optically transparent plates, respective dielectric multi-layer films formed on incidence surfaces of the optically transparent plates, and respective reflection preventing films formed on exit surfaces of the optically transparent plates. Polarized light transmission characteristics of the beam splitters 53, 54, 63, and 64 can be set by changing thicknesses of these films etc.

Figure 6:
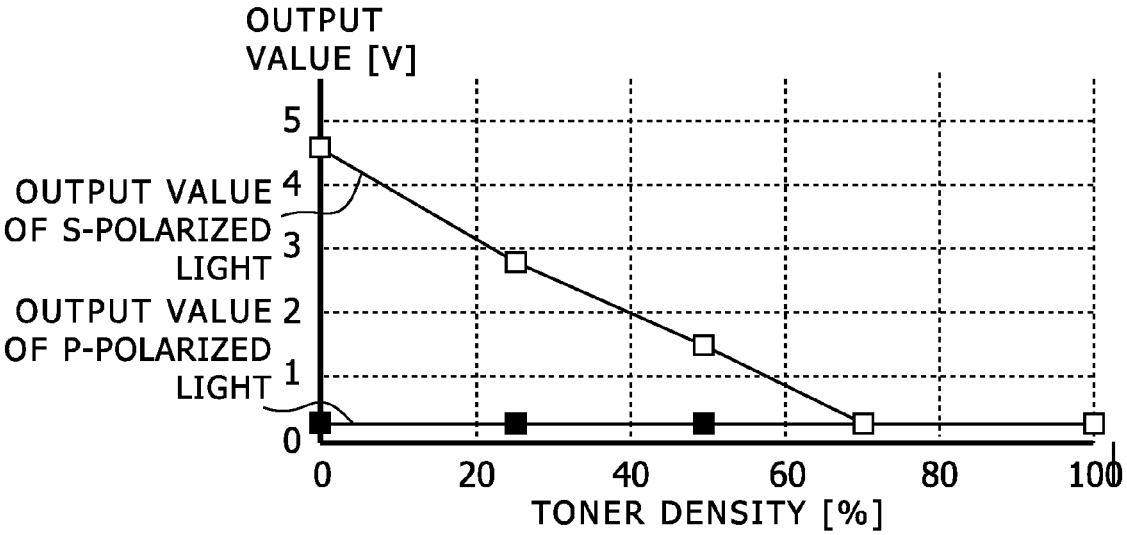
FIG. 6 is a diagram that shows an example of an output characteristic of the sensor 8*a* which irradiates S-polarized light.
Figure 7:
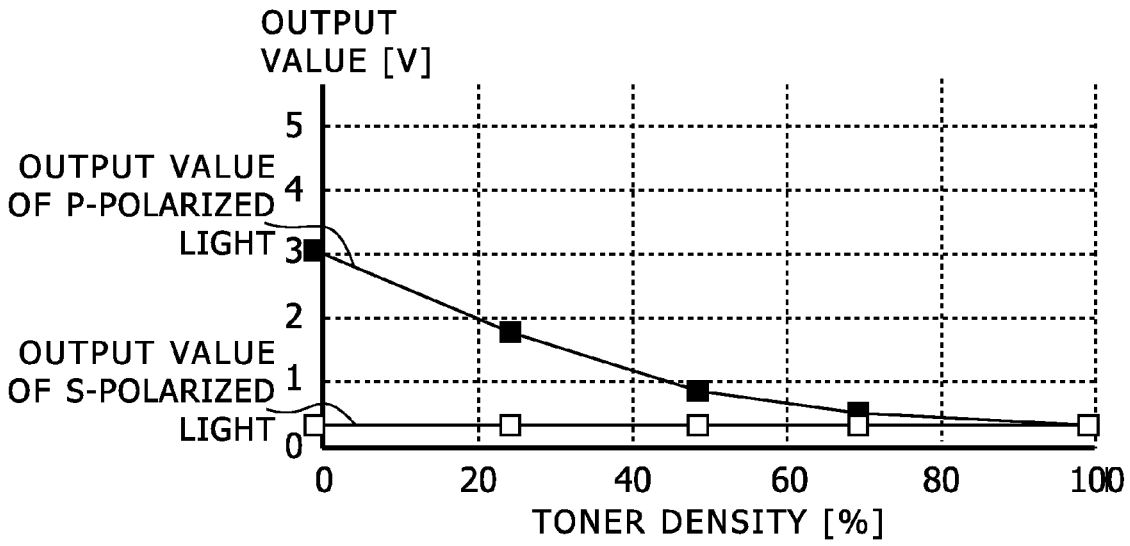
FIG. 7 is a diagram that shows an example of an output characteristic of the sensor 8*b* which irradiates P-polarized light.

FIG. 6 is a diagram that shows an example of an output characteristic of the sensor 8*a* which irradiates S-polarized light. FIG. 6 shows an example of output values from the first photo detector 55 (i.e. output values of S-polarized light) and output values from the second photo detector 56 (i.e. output values of P-polarized light) of the sensor 8*a* when densities of black toner patches are measured. FIG. 7 is a diagram that shows an example of an output characteristic of the sensor 8*b* which irradiates P-polarized light when the P-polarized light is irradiated to black toner patches. FIG. 7 shows an example of output values from the third photo detector 65 (i.e. output values of P-polarized light) and output values from the fourth photo detector 66 (i.e. output values of S-polarized light) of the sensor 8*b*.

As shown in FIGS. 6 and 7, in the low density range, differences (absolute values) between outputs of S-polarized light and P-polarized light of the sensor 8*a* irradiating S-polarized light are larger, and in the high density range, differences (absolute values) between outputs of S-polarized light and P-polarized light of the sensor 8*b* irradiating P-polarized light are larger. Therefore, the sensor 8*a* is used to measure toner patches in the low density range, and the sensor 8*b* is used to measure toner patches in the high density range.

In the following part, a behavior of the aforementioned image forming apparatus in the toner density adjustment is explained.

The print engine 11 rotates the intermediate transfer belt 4 using the driving rollers 5, and controls the exposure devices 2*a* to 2*d* to form toner patches of each color as shown in FIG. 3 at a predetermined area on a surface of the intermediate transfer belt 4.

The print engine 11 samples output signals from the photo detectors 55, 56, 65, and 66, and calculates measurement values of toner densities of respective toner patches 31-*i* and 32-*i* on the basis of the sampled values of the output signals. Amplifiers and so forth are disposed between the photo detectors 55, 55, 65, and 66 and the print engine 11 if necessary.

For example, the toner density is calculated with the following formula.

$$\text{Toner density [percent]}=\{1-(P-S)/(Po-So)\}\times 100$$

In this formula, P is a sensor output value (voltage) of a P-polarized component at the toner patch 31-*i* or 32-*i*; S is a sensor output value (voltage) of a S-polarized component at the toner patch 31-*i* or 32-*i*; Po is a sensor output value (voltage) of a P-polarized component at a position without any toner images (i.e. at a surface material of the intermediate transfer belt 4); and So is a sensor output value (voltage) of a S-polarized component at a position without any toner images (i.e. at a surface material of the intermediate transfer belt 4). The surface material where the sensor output values Po and So are measured is a position without toner images in front or behind of the toner patch 31-*i* or 32-*i* or a position where the toner patch 31-*i* or 32-*i* is to be formed (i.e. the same position where the sensor output values P and S are measured, but before the toner patch 31-*i* or 32-*i* is formed).

Consequently, measurement values are obtained of toner densities which corresponds to predetermined setting values (in FIG. 3, 12.5%, 25%, 37.5%, 50%, 62.5%, 75%, 87.5%, and 100%) of toner densities.

In order to adjust toner densities, the print engine 11 changes the development bias, the primary transfer bias, the exposure amount and so forth on the basis of the respective measurement values of each color.

The toner density adjustment is done in this manner.

In the aforementioned embodiment, the intermediate transfer belt 4 carries the toner patches 31-1 to 31-4 and 32-1 to 32-4; the sensor 8*a* irradiates S-polarized light to the toner patches 31-1 to 31-4 in a predetermined low density range, and receives reflection light from them; and the sensor 8*b* irradiates P-polarized light to the toner patches 32-1 to 32-4 in a predetermined high density range, and receives reflection light from them. The print engine 11 calculates toner densities of the toner patches 31-1 to 31-4 and 32-1 to 32-4 on the basis of output values of the sensors 8*a* and 8*b*.

Therefore, different light components are irradiated to respective toner patches in the low density range and in the high density range. Consequently, toner densities of the toner patches are precisely measured from a low density range to a high density range.

In particular, toner densities of toner patches made of black toner which absorbs a lot of light are precisely measured from a low density range to a high density range.

In general, as explained by Fresnel equations, if an object surface is a mirror surface or near a mirror surface, then the reflectance of S-polarized light is larger than that of P-polarized light. When a toner density is measured of a low density toner patch, the reflection light contains relatively a lot of reflection light from a surface material of the image carrier (i.e. the intermediate transfer belt 4). Therefore, S-polarized light is favorable for measuring a toner density of a low density toner patch.

Further, in case of a color toner (i.e. not black), when a toner density increases, reflection from the surface material decreases, but a diffused reflection component front the toner increases, and consequently, intensity of reflection light received by the sensor does not decrease much. However, since black toner which includes a particle made of carbon absorbs light, the sensor receives low intensity of light from the black toner. In addition, a particle made of carbon tends to absorb S-polarized light larger than P-polarized light.

Therefore, in particular for black toner, different light components are irradiated to respective toner patches in the low density range and in the high density range. Consequently, toner densities of the black toner patches are precisely measured from a low density range to a high density range.

The description of the present invention has been presented for purposes of illustration and description, and is not intended to be exhaustive or limited to the invention in the form disclosed.

For example, a color image forming apparatus is explained in the aforementioned embodiment. Alternatively, the aforementioned technique can be applied to a monochrome image forming apparatus.

Further, in the aforementioned embodiment, polarizing plates may be used instead of the beam splitters 53, 54, 63, and 64.

Furthermore, regarding toner patches in the low and the high density ranges of which densities are measured by the sensors 8*a* and 8*b*, the toner patches in the low density range and the toner patches in the high density range may be set so as to (a) make the difference (absolute value) between outputs of the first photo detector 55 and the second photo detector 56 larger than the difference (absolute value) between outputs of the third photo detector 65 and the fourth photo detector 66 for the low density range, and (b) make the difference (absolute value) between outputs of the third photo detector 65 and the fourth photo detector 66 larger than the difference (absolute value) between outputs of the first photo detector 55 and the second photo detector 56 for the high density range. Therefore, a sensor of which a difference between the specular reflection component and the diffuse reflection component in the reflection light is larger than that of the other sensor is used to measure the toner density in each of the density ranges.

Furthermore, in the aforementioned embodiment, the intermediate transfer belt 4 is an image carrier of the toner patches. Alternatively, the photoconductor drum may be used as an image carrier of the toner patches. Further, in case of a direct-transfer type image forming apparatus, a transfer belt which transfers a paper sheet may be used as an image carrier of the toner patches.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

an image carrier configured to carry toner patches;

a first sensor configured to irradiate S-polarized light to a low-density patch in a predetermined low density range among the toner patches, and to receive reflection light from the low-density patch; and a second sensor configured to irradiate P-polarized light to a high-density patch in a predetermined high density range among the toner patches, and to receive reflection light from the high-density patch.

2. The image forming apparatus according to claim 1, wherein:

the first sensor is further configured to irradiate S-polarized light to a low-density patch of black toner in a predetermined low density range among the toner patches, and to receive reflection light from the low-density patch; and the second sensor is further configured to irradiate P-polarized light to a high-density patch of black toner in a predetermined high density range among the toner patches, and to receive reflection light from the high-density patch.

3. The image forming apparatus according to claim 1, further comprising:

a toner density determining unit configured to determine a measurement value of a toner density on the basis of either an output of the first sensor or an output of the second sensor;

wherein:

the first sensor comprises a first photo detector configured to receive S-polarized component of the reflection light from the low-density patch, and a second photo detector configured to receive P-polarized component of the reflection light from the low-density patch, the second sensor comprises a third photo detector configured to receive P-polarized component of the reflection light from the high-density patch, and a fourth photo detector configured to receive S-polarized component of the reflection light from the high-density patch, and the toner density determining unit is further configured to determine the measurement value of the toner density on the basis of either a difference between outputs of the first photo detector and the second photo detect or a difference between outputs of the third photo detector and the fourth photo detect.

4. The image forming apparatus according to claim 3, wherein:

the first photo detector, the second photo detector, the third photo detector, and the fourth photo detector are further configured (a) to make the difference between outputs of the first photo detector and the second photo detector larger than the difference between outputs of the third photo detector and the fourth photo detector for the low density range, and (b) to make the difference between outputs of the third photo detector and the fourth photo detector larger than the difference between outputs of the first photo detector and the second photo detector for the high density range.

5. The image forming apparatus according to claim 2, further comprising:

a toner density determining unit configured to determine a measurement value of a toner density on the basis of either an output of the first sensor or an output of the second sensor;

wherein:

the first sensor comprises a first photo detector configured to receive S-polarized component of the reflection light from the low-density patch, and a second photo detector configured to receive P-polarized component of the reflection light from the low-density patch, the second sensor comprises a third photo detector configured to receive P-polarized component of the reflection light from the high-density patch, and a fourth photo detector configured to receive S-polarized component of the reflection light from the high-density patch, and the toner density determining unit is further configured to determine the measurement value of the toner density on the basis of either a difference between outputs of the first photo detector and the second photo detect or a difference between outputs of the third photo detector and the fourth photo detect.

6. The image forming apparatus according to claim 5, further comprising:

the first photo detector, the second photo detector, the third photo detector, and the fourth photo detector are further configured (a) to make the difference between outputs of the first photo detector and the second photo detector larger than the difference between outputs of the third photo detector and the fourth photo detector for the low density range, and (b) to make the difference between outputs of the third photo detector and the fourth photo detector larger than the difference between outputs of the first photo detector and the second photo detector for the high density range.

7. The image forming apparatus according to claim 1, wherein:

the image carrier is further configured to carry a series of low-density toner patches in the low density range and a series of high-density toner patches in the high density range in parallel.

* * * * *